United States Patent [19]

Brockman et al.

[11] 4,210,141

[45] Jul. 1, 1980

[54] HICCOUGH TREATMENT APPLIANCE

[75] Inventors: Raymond G. Brockman, Cleveland Heights, Ohio; William C. Nadeau, 2623 Queenston Rd., Cleveland Heights, Ohio 44118

[73] Assignee: William C. Nadeau, University Heights, Ohio

[21] Appl. No.: 858,793

[22] Filed: Dec. 8, 1977

[51] Int. Cl.[2] ..... A61J 1/00

[52] U.S. Cl. ..... 128/272; 220/90.2; 128/15; 128/222

[58] Field of Search ..... 229/16; 128/15, 272, 128/222; D7/6, 9; 220/90.2, 90.4, 90.6

[56] References Cited

U.S. PATENT DOCUMENTS

| | | | |
|---|---|---|---|
| D. 15,154 | 7/1884 | Gordon et al. | 28/116 |
| D. 34,708 | 7/1901 | Evans | 210/477 |
| D. 48,834 | 4/1916 | Sprung et al. | 56/173 |
| D. 165,778 | 1/1952 | Olsen | D36/8 |
| D. 173,121 | 9/1954 | Lynn | D44/1 |
| 560,916 | 5/1906 | McDonough | 220/90.2 |
| 809,952 | 1/1906 | Hoffa | 128/222 |
| 940,204 | 11/1909 | Simpson | 239/33 |
| 1,543,209 | 6/1925 | Fulton | 128/222 |
| 2,599,919 | 6/1952 | Hucknall | 220/90.6 |
| 2,673,563 | 3/1954 | Kwast | 128/222 |
| 2,885,134 | 9/1957 | Cohen | 229/1.5 |
| 3,069,046 | 12/1962 | Gram | 220/85 |
| 3,302,644 | 2/1967 | Kennedy et al. | 128/222 |
| 3,406,868 | 10/1968 | Rogers | 220/90.2 |
| 3,534,736 | 10/1970 | Meyers | 128/222 |
| 3,558,033 | 1/1971 | Leeds | 229/7 |
| 3,810,470 | 5/1974 | Von Gunten | 128/222 |
| 3,854,478 | 12/1974 | Cunningham | 128/222 |
| 4,135,512 | 1/1979 | Godsey | 128/222 |

FOREIGN PATENT DOCUMENTS

| | | | |
|---|---|---|---|
| 26564 | 7/1902 | Switzerland | 220/90.6 |

*Primary Examiner*—Robert W. Michell
*Assistant Examiner*—J. L. Kruter
*Attorney, Agent, or Firm*—Burge & Porter Co.

[57] ABSTRACT

A cup-like appliance for treating hiccoughs includes a container portion adapted to hold a quantity of liquid, a dispensing portion for dispensing the liquid, and a tongue-depressor portion adjacent the dispensing portion for projecting into the mouth of a person drinking liquid from the appliance to depress the person's tongue while the liquid is being swallowed.

6 Claims, 6 Drawing Figures

HICCOUGH TREATMENT APPLIANCE

BACKGROUND OF THE INVENTION

1. Field of the Invention

The present invention relates generally to the treatment of hiccoughs and, more particularly, to a cup-like hiccough treatment appliance having a tongue-depressor formation for engaging and depressing the tongue of a person drinking liquid from the container.

2. Prior Art

A hiccough is a sudden intake of air resulting from a spasmodic movement of the diaphragm, the large powerful, dome-shaped muscle at the base of the chest cavity that contracts and relaxes like a bellows in a gentle and rhythmic manner as a person breathes. The loud "hic" sound which accompanies hiccoughs results from a sudden closing of the epiglottis over the larynx as the diaphragm pulls a burst of air into the lungs through the larynx. As the epiglottis closes, the vocal cords which flank the larynx are caused to move, thereby generating the "hic" sound.

Hiccough spasms may occur several times a minute. The attack itself may last for several hours and, in some cases for several days. People have been known to die from exhaustion due to hiccoughs.

While a number of theories have postulated as to the cause of hiccoughs, it is believed that this annoying phenonema is not fully understood by anyone. Hiccoughs can apparently be instigated by a transient disturbance of the phrenic nerves which regulate the movement of the diaphragm, and by other causes which may vary considerably. Why hiccoughs stop once they have started seems to be as much a mystery as their cause.

A great many time-honored folk remedies have been proposed to treat hiccoughs, but most are found to be relatively unreliable. Proposed remedies include holding one's breath, drinking a glass of water without stopping, swallowing crushed ice, gargling, breathing into a paper bag, sucking half a lemon covered with sugar, and having one startle the victim.

Still another proposal which has been tried by some persons with a degree of success requires the careful manipulation of a cup and spoon during drinking of water from the cup. In accordance with this proposal, a spoon having an elongate handle is inserted into a cup or other small drinking container such that the handle of the spoon projects above the rim of the container a distance of about an inch. The victim of hiccoughs is then required to insert one or more fingers into the container to hold the spoon firmly against the side wall of the container while, at the same time, drinking several ounces of water from the container. If performed properly, and if the container and the spoon happen to have the proper mating configurations to properly position the handle of the spoon, the spoon handle will serve to depress the tip of the victim's tongue as he drinks water from the cup or glass.

A problem with the latter proposal is that the spoon and container selected for use may not provide the required type of tongue depression action and may, therefore, be entirely ineffective. Still another problem relates to the difficulty the victim encounters in trying to manipulate his hand to hold a spoon in proper position inside the container and with sufficient force to enable the spoon handle to function in a tongue depression capacity while, at the same time, drinking water from the container. Children and the infirm, in particular, have difficulty in effecting this feat. Inasmuch as most persons do not acquire hiccoughs very often, even those who understand the required procedure seldom become very proficient at it. Many people, particularly children, find the proposed remedy entirely too difficult to understand, much less carry out.

A further problem with the cup-and-spoon proposal is that, with many victims, the depression or restraining force applied to the tip of the tongue needs to be greater when the cup is tipped the most, i.e., during the latter part of the treatment procedure wherein the cup is being emptied. Since it is this time that the opening available between the rim of the cup and the victim's face is most restricted, it is exactly this time that the victim is most likely to lose control of the spoon or to apply insufficient force to the spoon, thereby destroying the effectiveness of the procedure.

In view of the widely acknowledged unreliability of previously proposed hiccough treatments, proposals for treating hiccoughs have come to be regarded with about the same dignity afforded proposals for perpetual motion machinery. Many people remain quite convinced that no effective treatment exists and that none will ever be found.

SUMMARY OF THE INVENTION

The present invention overcomes the foregoing and other drawbacks of the prior art by providing a novel and improved hiccough treatment appliance which is simple to use and has been found to operate effectively in many instances to treat hiccoughs.

In accordance with the preferred practice of the present invention, a cup-like appliance is provided which has structure defining a container adapted to receive a quantity of liquid. The structure has a dispensing portion configured to dispense liquid from the container into a person's mouth. A tongue depression formation is provided for engaging and depressing the tip of a person's tongue as liquid is dispensed from the container into the person's mouth. An indicator line or other suitable indicia is provided on the side wall of the container to indicate the level of liquid which should optimally be used during treatment. It is found that the operation of this relatively simple appliance can be easily understood by almost all persons including children. Moreover, it is found that almost all persons, including children, are able to use the appliance and that, in a majority of instances, the appliance is found to operate effectively to treat hiccoughs.

While the principle of operation of the appliance is not fully understood, it is believed that it may operate in the following manner. The phrenic motor nerve runs between the thorax and the diaphragm with a branch to the tongue. When the tongue is restrained in place during the swallowing of liquid dispensed from the appliance, the nerve signal generated as a result of this restraint is believed to interrupt nerve signals in the phrenic motor nerve which are causing the spasmodic contractions of the diaphragm. It is believed that an application of increasingly greater tongue restraining force is desirable as treatment utilizing the appliance progresses, and it is found that the tongue depression formation provides this desired increase in force as the appliance is progressively tipped during drinking. While the applicants are not certain that this theory fully explains the operation of the appliance of the present invention, it is the best explanation they have for the unexpectedly successful performance of appliances embodying the invention.

In more than 150 tests conducted prior to the filing of the present application, appliances embodying the preferred practice of the present invention did not fail, even once, to terminate victims' hiccoughs. Applicants do not purport that their applicance will effectively treat all cases of hiccoughs, but do believe the invention provides a much more reliable treatment than has previously been available.

It is an object of the present invention to provide a novel and improved appliance for treating hiccoughs.

It is a further object to provide a novel and improved hiccough treatment appliance, the operation of which can be readily understood by most persons, including children.

It is a further object of the present invention to provide a novel and improved hiccough treatment appliance which can be used easily and effectively by most persons, including children.

These and other objects and a fuller understanding of the invention described and claimed in the present application may be had by referring to the following description and claims taken in conjunction with the accompanying drawings.

DESCRIPTION OF THE PREFERRED EMBODIMENT

Figure 1:
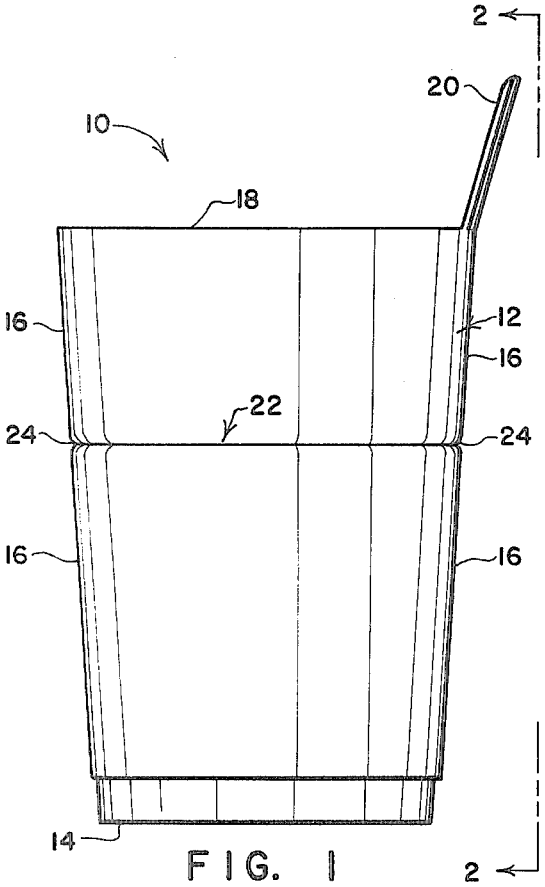
FIG. 1 is a side elevational view of a hiccough treatment appliance embodying the preferred practice of the present invention.
Figure 2:
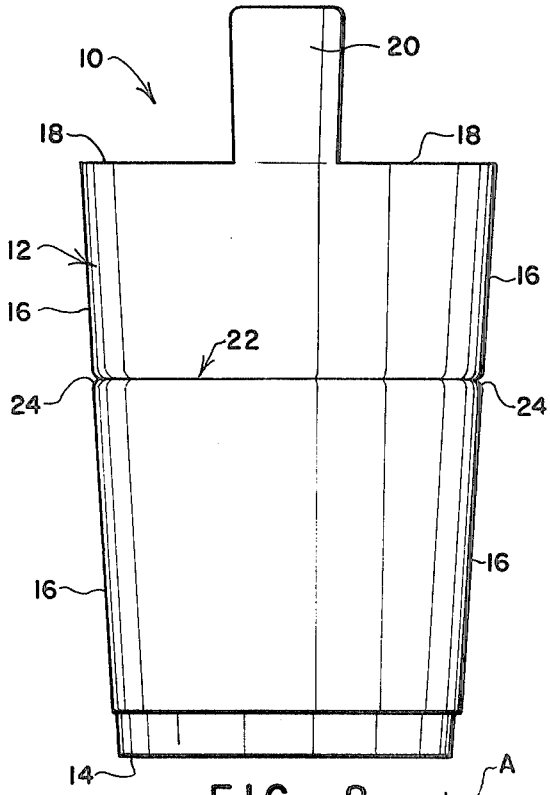
FIG. 2 is a side elevational view of the appliance of FIG. 1 as seen substantially from a plane indicated by a line 2—2 in FIG. 1.
Figure 3:
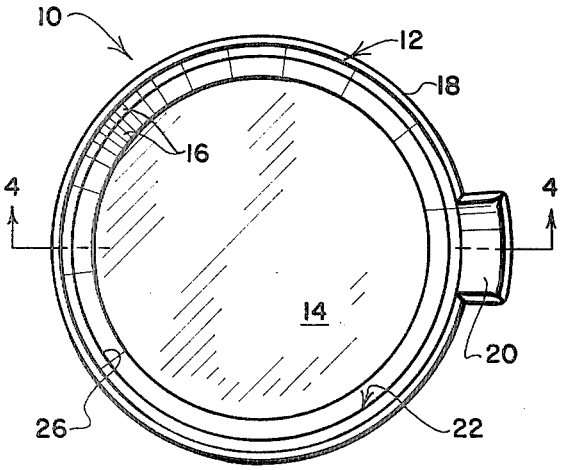
FIG. 3 is a top plan view of the appliance of FIG. 1.

Referring to FIGS. 1–4, a hiccough treatment appliance embodying the preferred practice of the present invention is indicated generally by numeral 10. The appliance 10 includes a cup-like container 12 having a bottom wall portion 14 and frustoconical side wall portions 16 which diverge slightly as they extend away from the bottom wall portion 14 to define a tapered-wall container with the side wall portions 16 making an angle of about ninety-three degrees with the plane of the bottom wall portion 14. A dispensing portion in the form of a rim 18 is provided at the upper end of the side wall portions 16.

Figure 4:
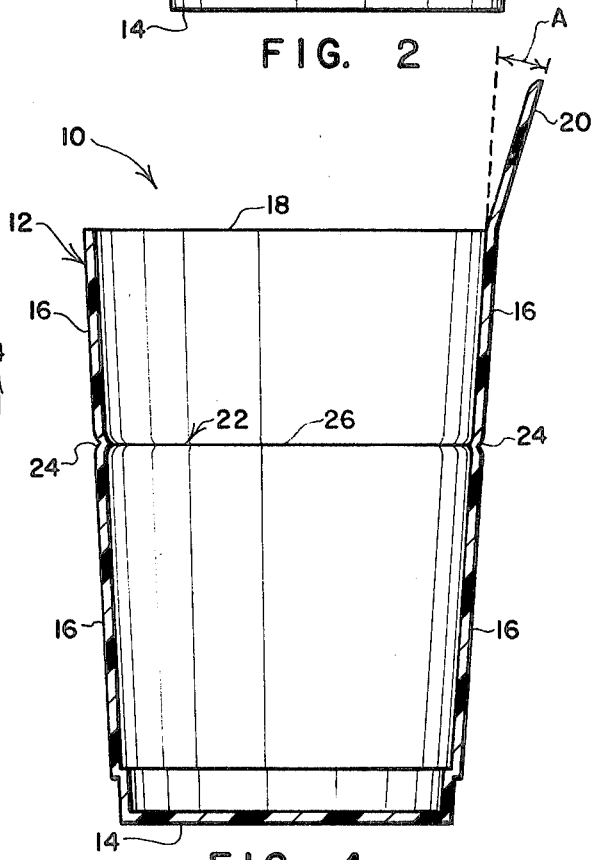
FIG. 4 is a sectional view as seen from a plane indicated by a line 4—4 in FIG. 3; and , FIGS. 5 and 6 are schematic views illustrating the appliance of FIG. 1 during different stages of use.

A curved but essentially rectangularly shaped tongue-depressor projection 20 is formed integrally with the side wall portions 16 and projects upwardly from the rim 18. The tongue depressor projection 20 has substantially the same curvature as the side wall portions 16 but, as is best seen in FIG. 4, is inclined relative to its adjacent side wall portion 16 by an angle indicated by an arrow A. As will be explained, the angle A is preferably within the range of about two to twenty-five degrees, the preferred angle A being seventeen degrees.

A liquid level indicator line 22 is preferably provided on the side wall portions 16 so that the user of the appliance 10 will know approximately what quantity of liquid to provide in the container 12. In the preferred practice of the present invention, the liquid level indicator line 22 is provided by forming an inwardly extending depression 24 in the outer surface of the side wall portions 16 which, in turn, results in an inwardly protruding ring 26 being formed on the inner surface of the side wall portions 16, as best seen in FIG. 4.

In preferred practice, the appliance 10 assumes substantially the configuration indicated in the drawings and is adapted to hold approximately four to six ounces of liquid when filled to the indicator line 22. The appliance 10 illustrated in the drawings has a container-filled capacity of about nine ounces with the indicator line 22 positioned at about the five ounce level. The tongue-depressor projection 20 preferably has a length of about one inch and a width of about three-fourths inches. The appliance 10 illustrated in the drawings has a base diameter of about two and three sixteenths inches, a rim diameter of about two and three-fourths inches, a side wall height of about three and seven-eighths inches and an overall height of about four and seven-eighths inches. In preferred practice angle A is seventeen degrees, but can be within a range of about two to twenty-five degrees. As will be readily apparent to those skilled in the art, other dimensional configurations of the container 12 can also be utilized, and other ranges of the angle A can be selected as may be required to effect a proper tongue depression action with differently configured containers.

Figure 5:
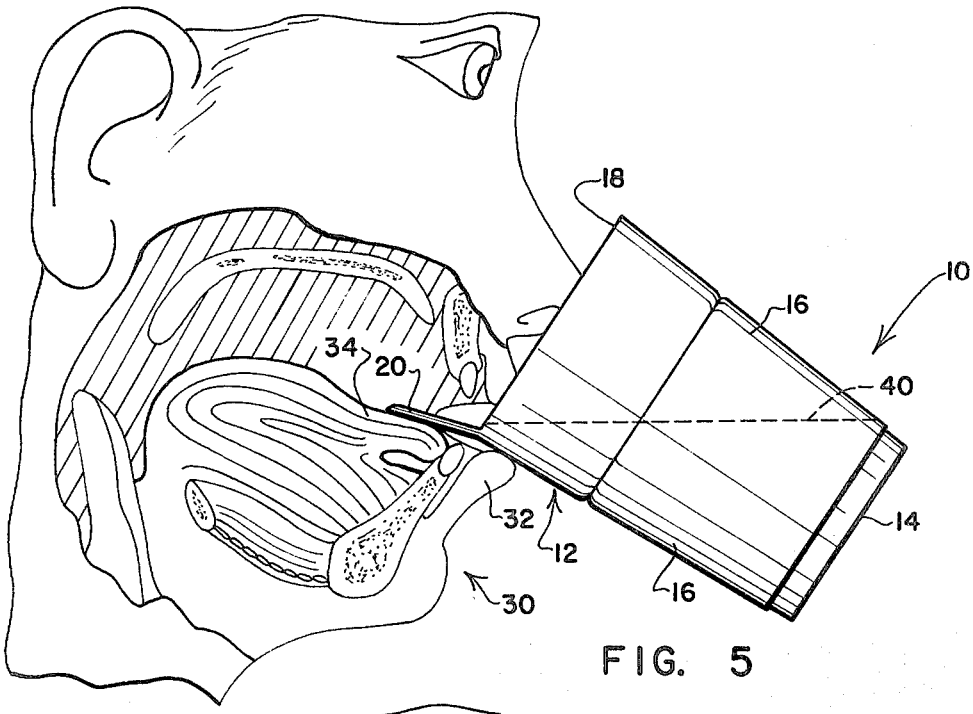
Figure 6:
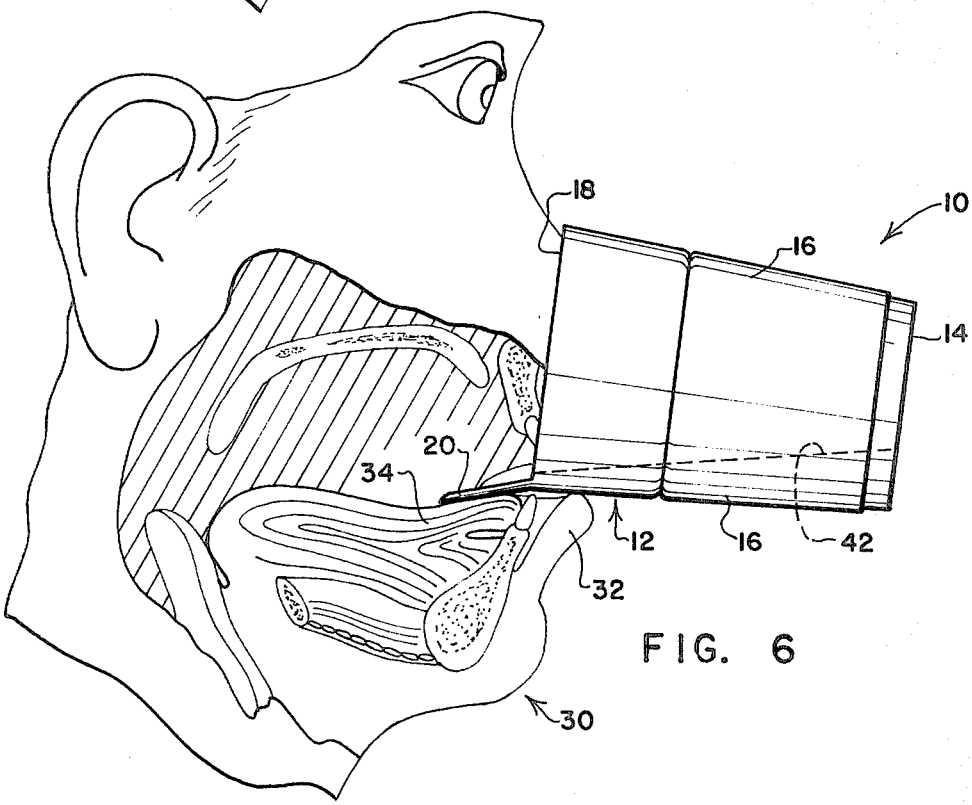

Referring to FIG. 5, when the appliance 10 is positioned, as shown, to begin the dispensing of a liquid such as water into the mouth of a hiccough victim, indicated generally by the numeral 30, the side wall portion 16 which lies adjacent the tongue-depressor projection 20 is positioned in engagement with the victim's lower lip 32, just as is the practice in using an ordinary cup or drinking glass. The tongue-depressor projection 20 overlies and engages the tip or forward end of the victim's tongue 34. As the appliance 10 is tipped to bring the level of liquid in the container into a dispensing attitude, as indicated by a line 40, the appliance 10 essentially pivots about its locus of engagement with the lower lip 32. During this tipping or pivoting action, the tongue-depressor projection 20 is brought into firm restraining engagement with the victim's tongue 34. Tipping of the appliance continues during the drinking of dispensed liquid with a resulting pivoting of the tongue-depressor projection 20 into progressively more forceful restraining engagement with the tongue 34. When a majority of the liquid in the container 12 has been dispensed, leaving a liquid level as indicated by a line 42 in FIG. 6, the tongue 34 is quite firmly depressed and restrained at what is believed to be the most crucial time requiring maximum restraining force.

The appliance 10 is preferably formed from injection molded plastics material of a type which is safe for use, which resists attack by such detergent and cleanser substances as are commonly found in the home, and which can be washed in a conventional dishwasher. The preferred material is polypropylene, and it or other suitable materials can be utilized in a transparent or a translucent form.

While the applicants have considered other forms of the invention wherein the container 12 and the tongue-depressor projection 20 are provided as separate pieces, it is believed that the described preferred embodiment is superior to a two piece construction. A problem encountered where the container 12 and the tongue-depressor projection 20 are formed separately is that of providing a sufficiently rigid connection between these parts which will permit the transmission therebetween of the required tongue restraining forces. Still another problem is that of providing a connection between the two pieces which will not obstruct or encumber proper use of the appliance 10, and which will not cause spilliage or leakage of liquid during use of the appliance 10.

A possibility which has been considered by the applicants is that of providing a container 12 with a movably carried tongue-depressor projection 20, whereby the protrusion length of the projection 20 could be adjusted to have a shorter length for use with children and a longer length for use with adults. Tests have indicated, however, that a depressor projection length of about one inch will accommodate children as well as adults, thereby obviating the need for a more complex adjustable embodiment of the appliance 10.

As will be apparent from the foregoing summary and description, the present invention provides a novel and improved, simple and inexpensive appliance for treating hiccoughs. The steps involved in utilizing the appliance are easy to understand and can be followed without difficulty by most persons, including children. No unusually dexterous manipulations are required to use the appliance. Quite to the contrary, its use relies on manipulative skills most persons have already acquired, namely the ability to hold a cup or glass to the mouth and drink from it.

Although the invention has been described in its preferred form with a certain degree of particularity, it is understood that the present disclosure of the preferred form has been made only by way of example and that numerous changes in the details of construction and the combination and arrangements of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A hiccough treatment appliance, comprising:

(a) structure defining an upwardly opening container having a bottom portion configured to be supported atop a flat horizontal surface and a rim portion extending perimetrically about the top of the container when the bottom portion is supported atop a flat horizontal surface;

(b) a relatively flat, thin, tab-like projection means extending predominantly upwardly when the appliance is positioned with the bottom portion supported atop a flat horizontal surface:

(i) for insertion a short distance into the mouth of a person in overlying relationship with the frontal tip portion of the person's tongue as the rim portion is brought toward a position of engagement with the person's lower lip;

(ii) for engaging in overlying relationship the frontal tip portion of the person's tongue as the rim portion is brought into firm seating engagement with the person's lower lip;

(iii) for firmly depressing the frontal tip portion of the person's tongue as the appliance is tipped while in seating engagement with the person's lower lip to dispense liquid from the container into the forward part of the person's mouth; and (iv) for continuing to depress the frontal tip portion of the person's tongue and to thereby restrain tongue movement as such liquid is swallowed;

(c) the structure and the projection means being formed as a single, one piece, integral member;

(d) the tab-like projection means consisting of a tab-like structure which extends upwardly from a part of the perimetrically extending rim, the tab-like structure having a width, as measured along the rim part, which is relatively narrow in comparison with the perimeter of the rim, the tab-like structure being relatively short in length to effect engagement and depression of only the frontal tip portion of the person's tongue when the appliance is tipped to dispense liquid into the person's mouth;

(e) the tab-like structure extending upwardly from the rim at an angle of inclination relative to the plane of an adjacent side wall part, the angle of inclination being within the range of about two to twenty-five degrees;

(f) the container side wall being provided with indicia means for indicating an appropriate level of liquid in the container means to be utilized in hiccough treatment, the container holding approximately four to six ounces of liquid when being supported atop a flat horizontal surface and being filled to the level of the indicia means; and (g) the indicia means being located at a sufficient distance below the rim to permit the container to be tipped while in engagement with a person's lower lip and to permit the tongue depression means to be brought into overlying engagement with the frontal tip portion of the person's tongue before liquid is dispensed from the container into the person's mouth.

2. The appliance of claim 1 wherein the indicia means is viewable both from the inside and the outside of the container.

3. The appliance of claim 1 wherein the indicia means includes a formation extending perimetrically about the container.

4. The appliance of claim 1 wherein the indicia means is at a level which will result in a quantity of about four to six ounces of liquid being introduced into the container for use in hiccough treatment.

5. The appliance of claim 1 wherein the structure has a side wall portion which is frustoconically shaped.

6. The appliance of claim 5 wherein the tab-like projection comprises an integral extension of a part of the side wall, and is inclined with respect to the plane of such adjacent side wall part.

* * * * *